US006896146B1

(12) United States Patent
Corrado

(10) Patent No.: US 6,896,146 B1
(45) Date of Patent: May 24, 2005

(54) CREMATED REMAINS CONTAINER DISPLAY AND RACKING SYSTEM

(76) Inventor: Stephen Corrado, 13700 74th Ave., Seminole, FL (US) 33776-3801

( * ) Notice: Subject to any disclaimer, the term of this patent is extended or adjusted under 35 U.S.C. 154(b) by 171 days.

(21) Appl. No.: 10/287,347

(22) Filed: Nov. 4, 2002

(51) Int. Cl.[7] ..... A47F 7/00

(52) U.S. Cl. ..... 211/85.27; 211/71.01; 27/1

(58) Field of Search ..... 211/85.27, 88.01, 211/71.01, 75, 13.1; 27/1

(56) References Cited

U.S. PATENT DOCUMENTS 3,254,773 A * 6/1966 Diem
3,259,445 A * 7/1966 Saxon
4,607,417 A * 8/1986 Hancovsky ..... 27/1
5,195,812 A * 3/1993 Eickhof
5,625,933 A * 5/1997 Neuberger et al. ..... 27/1
5,881,505 A * 3/1999 Larkin et al. ..... 211/85.27 X
6,167,600 B1 * 1/2001 Williams et al. ..... 27/1
6,347,439 B1 * 2/2002 Bach Lahor ..... 27/1
6,520,606 B1 * 2/2003 Robinson ..... 27/1 X

* cited by examiner

*Primary Examiner*—Robert W. Gibson, Jr.
(74) *Attorney, Agent, or Firm*—Edward P. Dutkiewicz

(57) ABSTRACT

A cremated remains container display and racking system has a pair of columns each having a back face, a front face and a flange with a plurality of bores. A pair of strips with a flat rear face and an outer face are adapted to be positioned over the flange of the columns. A plurality of urns have a front display face, a pair of side faces, a sealable bottom face, a rear face and a sealable cap. The display face has decorative indicia and a permanent picture thereon. The rear face has a pair of flanges projecting from the sides. A plurality of fasteners are adapted to couple the strips to the flanges of the urn to the interior flanges of the columns thus forming the display system.

5 Claims, 6 Drawing Sheets

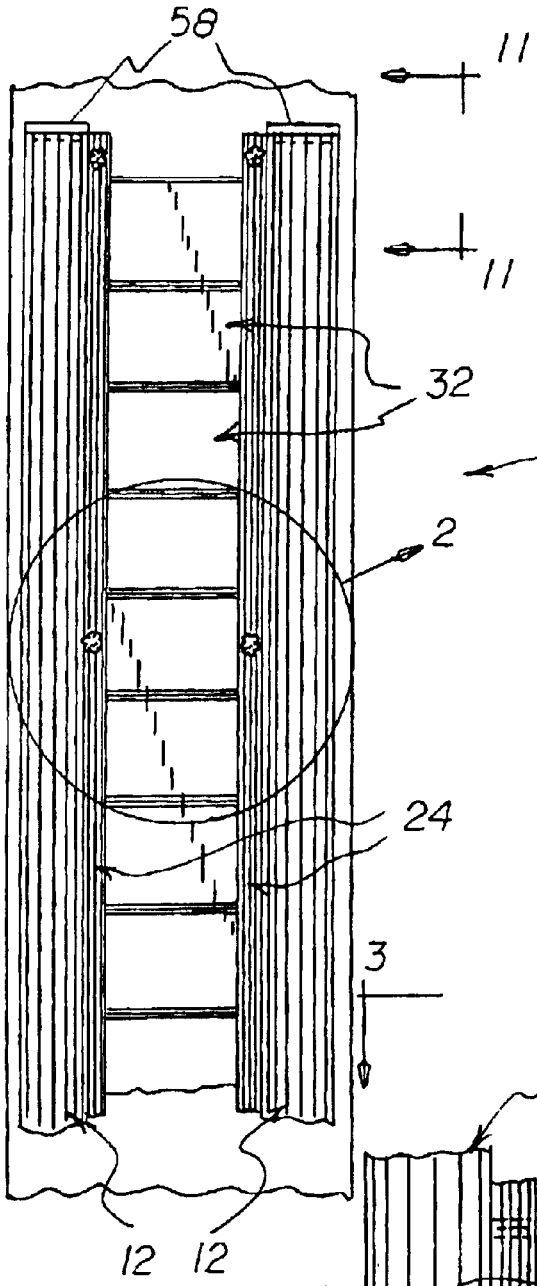
FIG 1
FIG 2
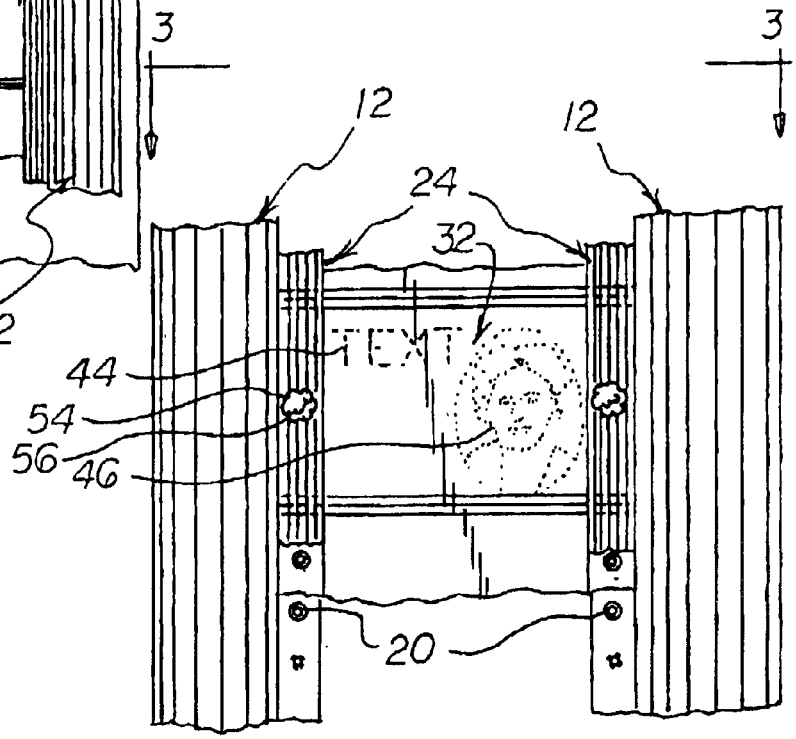

FIG 3
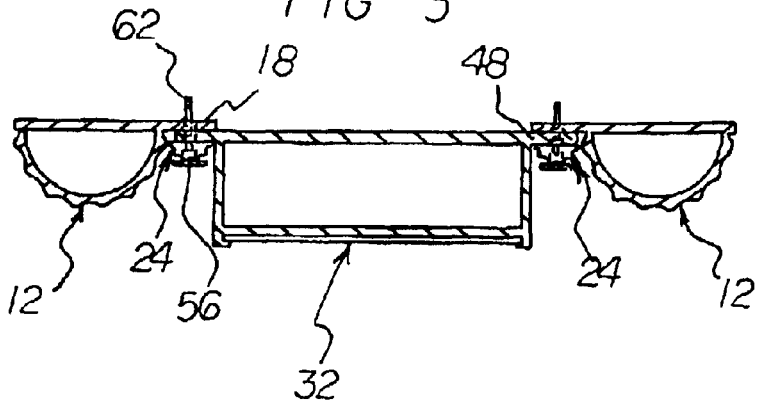
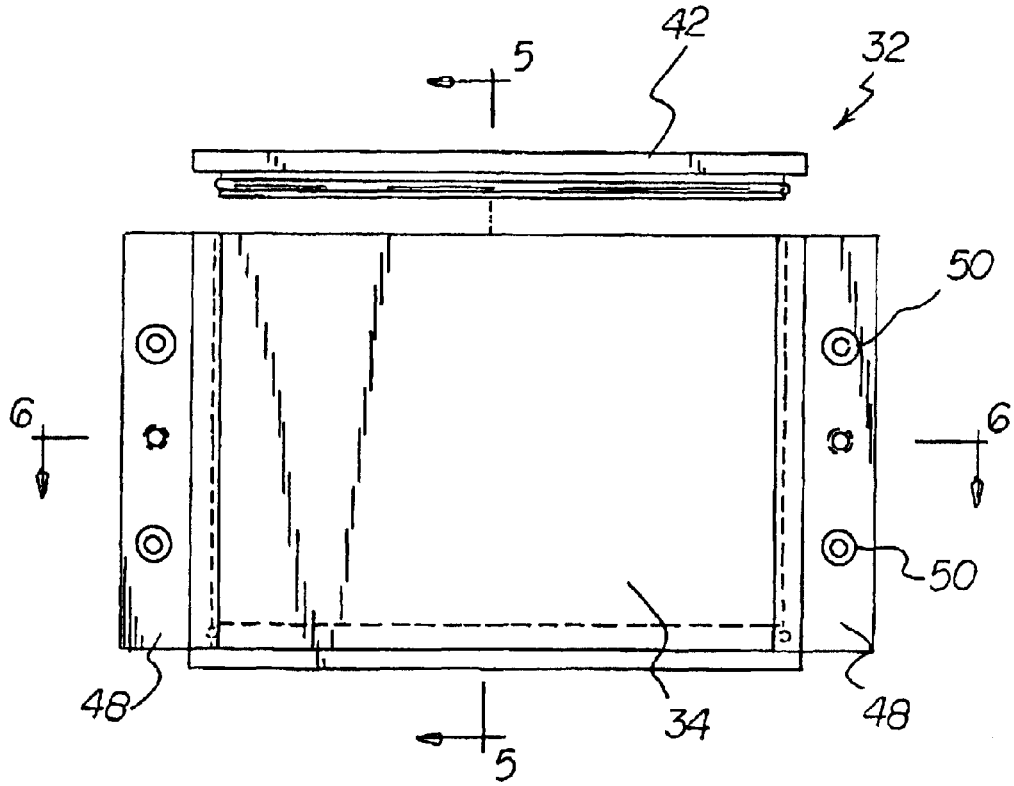
FIG 4

FIG 7
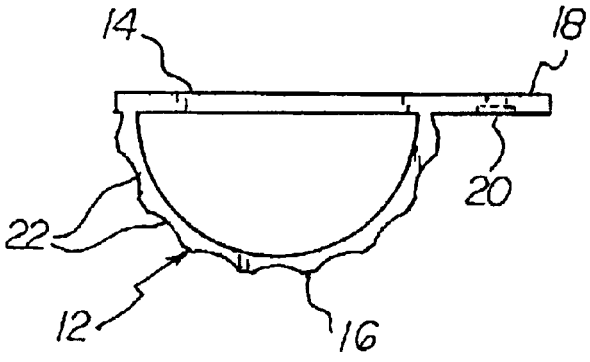
FIG 9
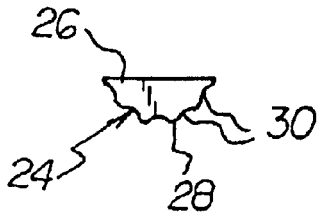
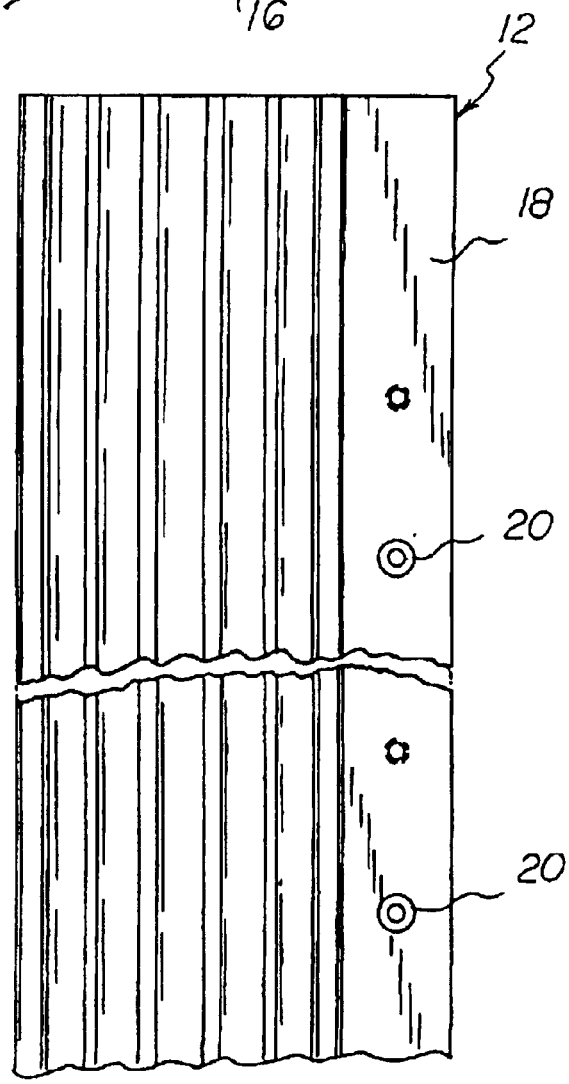
FIG 8
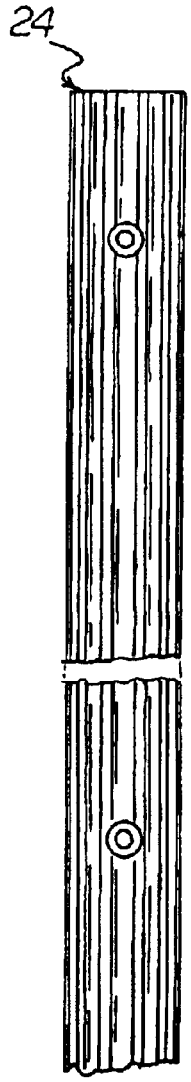
FIG 10

12

62
12
62
60
32
60
60
54
58
60
24
56
24
54

CREMATED REMAINS CONTAINER DISPLAY AND RACKING SYSTEM

BACKGROUND OF THE INVENTION

1. Field of the Invention

The present invention relates to a cremated remains container display and racking system and more particularly pertains to decoratively and efficiently storing cremated remains.

2. Description of the Prior Art

The use of cremation systems of known designs and configurations is known in the prior art. More specifically, cremation systems of known designs and configurations previously devised and utilized for the purpose of storing remains by conventional methods and apparatuses are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the aforementioned patents do not describe a cremated remains container display and racking system that allows decoratively and efficiently storing cremated remains.

In this respect, the cremated remains container display and racking system according to the present invention substantially departs from the conventional concepts and designs of the prior art, and in doing so provides an apparatus primarily developed for the purpose of decoratively and efficiently storing cremated remains.

Therefore, it can be appreciated that there exists a continuing need for a new and improved cremated remains container display and racking system which can be used for decoratively and efficiently storing cremated remains. In this regard, the present invention substantially fulfills this need.

SUMMARY OF THE INVENTION

In view of the foregoing disadvantages inherent in the known types of cremation systems of known designs and configurations now present in the prior art, the present invention provides an improved cremated remains container display and racking system. As such, the general purpose of the present invention, which will be described subsequently in greater detail, is to provide a new and improved cremated remains container display and racking system and method which has all the advantages of the prior art and none of the disadvantages.

To attain this, the present invention essentially comprises a pair of columns of a generally tall vertical configuration. Each column has a flush back face, a semi-cylindrical front face and an interior flange. Each interior flange has a plurality of bores therethrough. Each semi-cylindrical front face has a vertical extent with a plurality of undulations running along the vertical extent.

A pair of semi-cylindrical strips are next provided. Each strip has a flat rear face and a curved outer face with a plurality of undulations running along the outer face. The strips are adapted to be positioned over the interior flange of the columns.

Next provided is a plurality of rectilinear urns. Each urn has a front display face, a pair of side faces, a sealable bottom face, a rear face and a sealable cap. Each display face has decorative indicia including a permanent picture thereon. Each rear face has a pair of flanges projecting from the sides with each flange having a plurality of bores. Each cap has a tubular gasket adapted to provide a watertight seal.

A plurality of screws are next provided. The screws have a decorative flowered head and a driving end. The screws are adapted to couple the strips to the flanges of the urn. Short bolts couple the flanges of the urn to the interior flanges of the columns and long bolts couple the columns to a recipient surface such as a wall thereby forming the display system. A plurality of urns are held in place on either side by the columns and the plurality of flanges are concealed by the pair of strips.

Finally, a pair of decorative toppers are provided. The decorative toppers function to provide a flush cap to the columns.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cremated remains container display and racking system which has all of the advantages of the prior art cremation systems of known designs and configurations and none of the disadvantages.

It is another object of the present invention to provide a new and improved cremated remains container display and racking system which may be easily and efficiently manufactured and marketed.

It is further an object of the present invention to provide a new and improved cremated remains container display and racking system which is of durable and reliable constructions.

An even further object of the present invention is to provide a new and improved cremated remains container display and racking system which is susceptible of a low cost of manufacture with regard to both materials and labor, and which accordingly is then susceptible of low prices of sale to the consuming public, thereby making such cremated remains container display and racking system economically available to the buying public.

Even still another object of the present invention is to provide a cremated remains container display and racking system for decoratively and efficiently storing cremated remains.

Lastly, it is an object of the present invention to provide a new and improved cremated remains container display and racking system having a pair of columns each with a back face, a front face and a flange with a plurality of bores. A pair of strips with a flat rear face and an outer face are adapted to be positioned over the flange of the columns. A plurality of urns have a front display face, a pair of side faces, a sealable bottom face, a rear face and a sealable cap. The display face has decorative indicia and a permanent picture thereon. The rear face has a pair of flanges projecting from the sides. A plurality of fasteners are adapted to couple the strips to the flanges of the urn to the interior flanges of the columns thus forming the display system.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration showing the plurality of urns being held by the columns.

FIG. 2 is view of the present invention taken from circle 2 of FIG. 1.

FIG. 3 is cross sectional view of the present invention taken along line 3—3 of FIG. 2.

FIG. 4 is a plan view of an individual urn of the present invention.

FIG. 7 is a top view of one column of the present invention.

FIG. 8 is a plan view of one column of the present invention.

FIG. 9 is a top view of one strip of the present invention.

FIG. 10 is a plan view of a strip of the present invention.

The same reference numerals refer to the same parts throughout the various Figures.

DESCRIPTION OF THE PREFERRED EMBODIMENT

Figure 5:
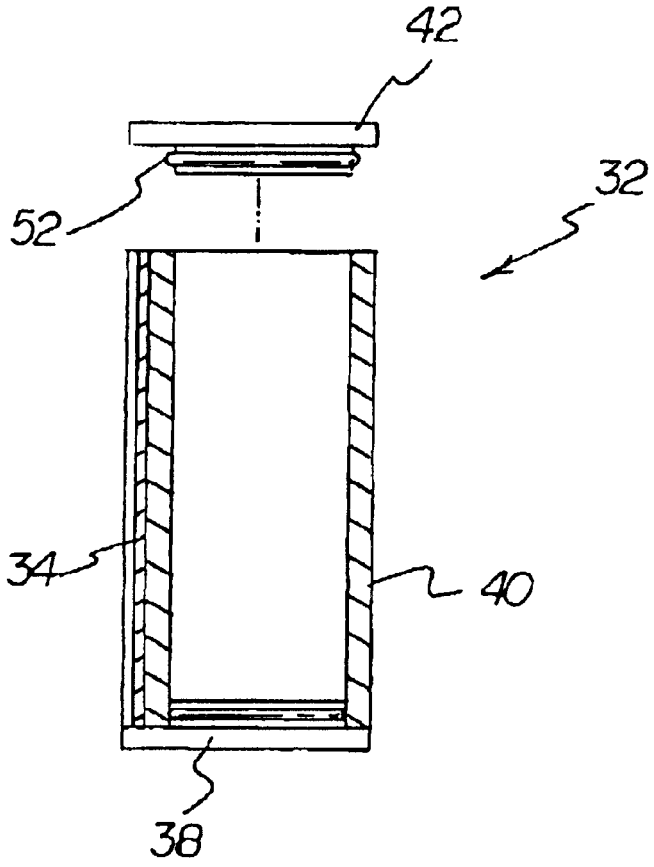
FIG. 5 is a cross sectional view taken along line 5—5 of FIG. 4.
Figure 6:
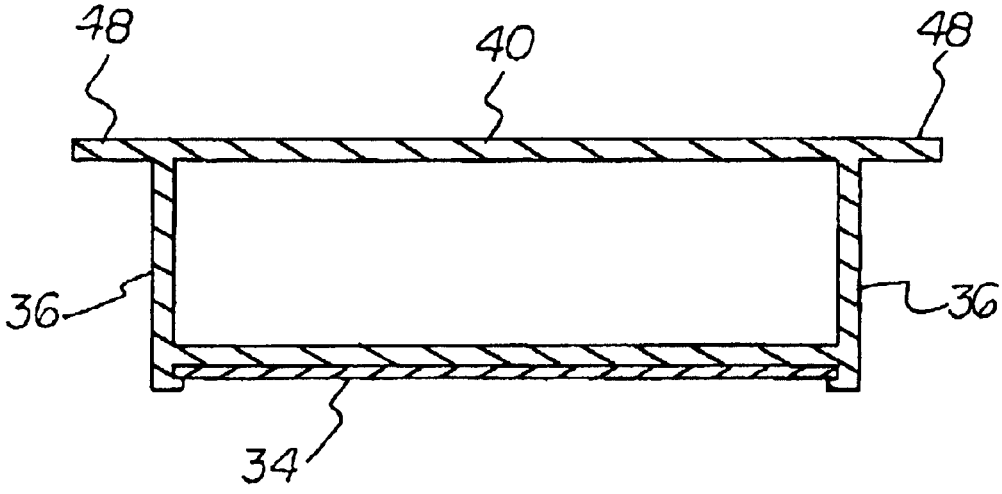
FIG. 6 is a cross sectional view taken along line 6—6 of FIG. 4.
Figure 11:
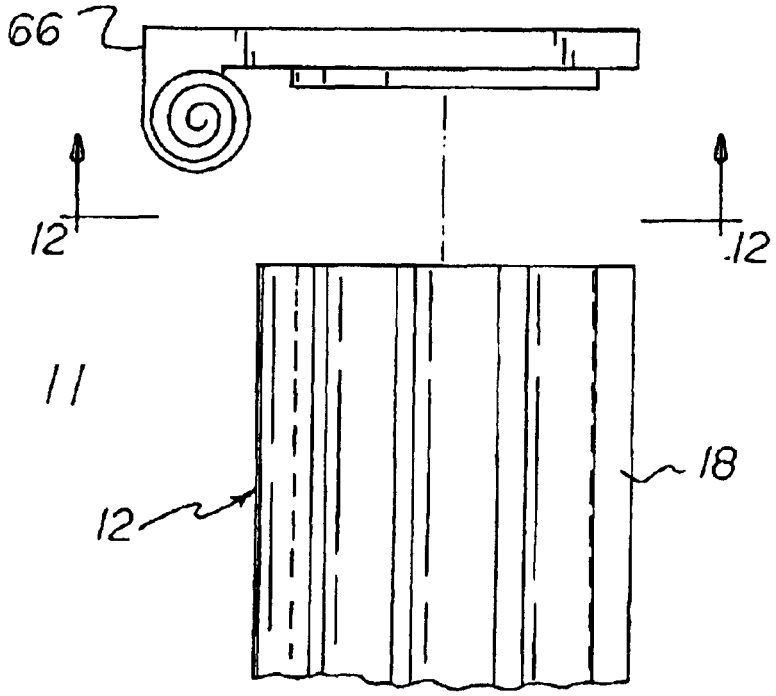
FIG. 11 is an exploded view showing the topper of a column.
Figure 12:
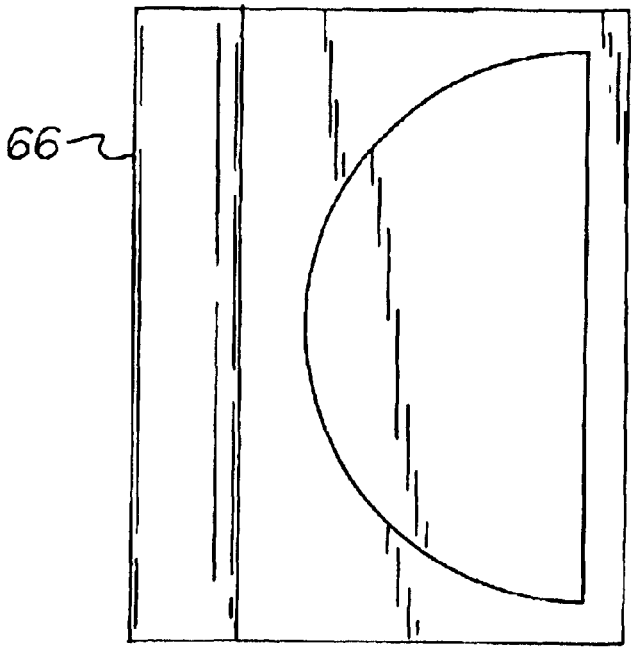
FIG. 12 is a bottom view of the topper.
Figure 13:
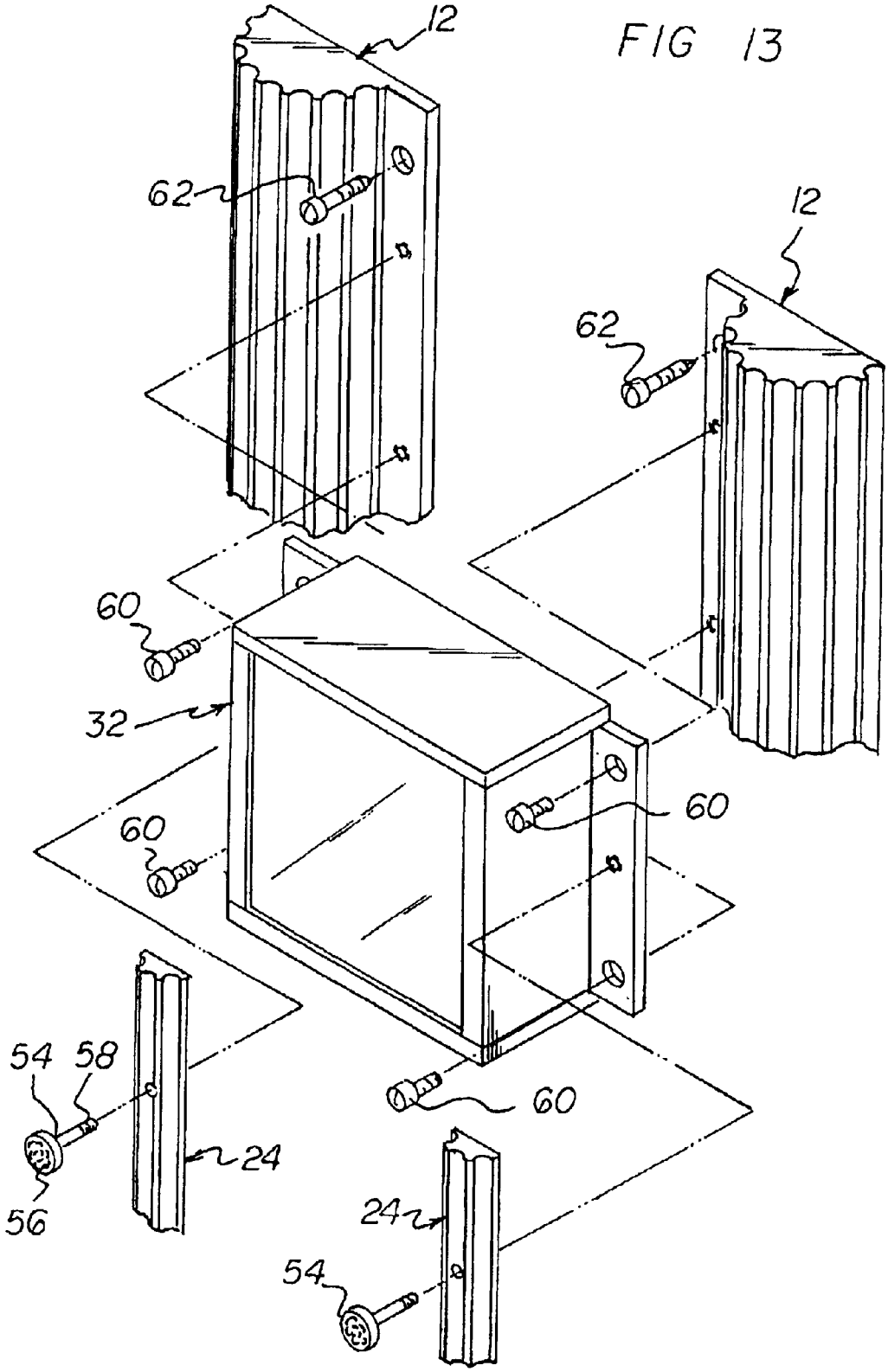
FIG. 13 is an exploded perspective illustration of the system.

With reference now to the drawings, and in particular to FIG. 1 thereof, the preferred embodiment of the new and improved cremated remains container display and racking system embodying the principles and concepts of the present invention and generally designated by the reference numeral 10 will be described.

The present invention, the cremated remains container display and racking system 10 is comprised of a plurality of components. Such components in their broadest context include a base, a central tube, a lid and a round gasket. Such components are individually configured and correlated with respect to each other so as to attain the desired objective.

To attain this, the present invention essentially comprises a pair of columns 12 of a generally tall vertical configuration. Each column has a flush back face 14, a semi-cylindrical front face 16 and an interior flange 18. Each interior flange has a plurality of bores 20 therethrough. Each semi-cylindrical front face has a vertical extent with a plurality of undulations 22 running along the vertical extent.

A pair of semi-cylindrical strips 24 are next provided. Each strip has a flat rear face 26 and a curved outer face 28 with a plurality of undulations 30 running along the outer face. The strips are adapted to be positioned over the interior flange of the columns.

Next provided is a plurality of rectilinear urns 32. Each urn has a front display face 34, a pair of side faces 36, a sealable bottom face 38, a rear face 40 and a sealable cap 42. Each display face has decorative indicia 44 including a permanent picture 46 thereon. Each rear face has a pair of flanges 48 projecting from the sides with each flange having a plurality of bores 50. Each cap has a tubular gasket 52 adapted to provide a watertight seal.

A plurality of screws 54 are next provided. The screws have a decorative flowered head 56 and a driving end 58. The screws are adapted to couple the strips to the flanges of the urn. Short bolts 60 couple flanges of the urn to the interior flanges of the columns and long bolts 62 couple the columns to a recipient surface such as a wall thereby forming the display system. A plurality of urns are held in place on either side by the columns and the plurality of flanges are concealed by the pair of strips.

Finally, a pair of decorative toppers 66 are provided. The decorative toppers function to provide a flush cap to the columns.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, faling within the scope of the invention.

What is claimed as being new and desired to be protected by Letters Patent of The United States is as follows:

1. A cremated remains container display and racking system for decoratively and efficiently storing cremated remains comprising, in combination:

a pair of columns of a generally tall vertical configuration and each having a flat back face, a semi-cylindrical front face and an interior flange, the interior flange having a plurality of bores there through, the semi-cylindrical front face having a vertical extent with a plurality of undulations running along the vertical extent;

a pair of semi-cylindrical strips with a flat rear face and a curved outer face with a plurality of undulations running along the outer face and being adapted to be positioned over the interior flange of the columns;

a plurality of urns having a rectilinear front display face, a pair of rectilinear side faces, a rectilinear sealable bottom face, a rectilinear rear face and a sealable cap, the display face having decorative indicia including a permanent picture thereon, the rear face having a pair of flanges projecting from the sides with each flange having a plurality of bores and the cap having a tubular gasket adapted to provide a water tight seal;

a plurality of screws having a decorative flowered head and a driving end, the screws being adapted to couple the strips to the flanges of the urn, short bolts coupling the flanges of the urn to the interior flanges of the columns, long bolts coupling the columns to a recipient surface thereby forming the display system wherein a plurality of urns are held in place on either side by the columns and the plurality of flanges being concealed by the pair of strips; and a pair of decorative toppers adapted to provide a flush cap to the columns.

2. A cremated remains container display and racking system comprising:

a pair of columns each having a back face, a front face and a flange having a plurality of bores there through;

a pair of strips with a flat rear face and an outer face being adapted to be positioned over the flange of the columns;

a plurality of urns having a front display face, a pair of side faces, a sealable bottom face, a rear face and a sealable cap, the display face having decorative indicia and a permanent picture thereon, the rear face having a pair of flanges projecting from the sides; and a plurality of fasteners adapted to couple the strips to the flanges of the urn to the interior flanges of the columns thus forming the display system.

3. The system as set forth in claim 2 wherein each flange has a plurality of bores and the cap has a tubular gasket adapted to provide a watertight seal.

4. The system as set forth in claim 2 wherein a plurality of urns are held in place on either side by the columns and the plurality of flanges are concealed by the pair of strips.

5. The system as set forth in claim 2 and further including a pair of decorative toppers adapted to provide a flush cap to the columns.

* * * * *